US011165173B2

(12) United States Patent
Moore

(10) Patent No.: US 11,165,173 B2
(45) Date of Patent: Nov. 2, 2021

(54) EXTERNAL SWITCH TO CONNECT OR DISCONNECT UNDERGROUND TRACER WIRE AND GROUND WIRE

(71) Applicant: Copperhead Industries, LLC, Monticello, MN (US)

(72) Inventor: Michael S. Moore, Monticello, MN (US)

(73) Assignee: COPPERHEAD INDUSTRIES, LLC, Monticello, MN (US)

( * ) Notice: Subject to any disclaimer, the term of this patent is extended or adjusted under 35 U.S.C. 154(b) by 172 days.

(21) Appl. No.: 16/562,965

(22) Filed: Sep. 6, 2019

(65) Prior Publication Data

US 2020/0083617 A1 Mar. 12, 2020

Related U.S. Application Data

(60) Provisional application No. 62/728,210, filed on Sep. 7, 2018, provisional application No. 62/821,815, filed on Mar. 21, 2019.

(51) Int. Cl.

| | |
|---|---|
| ***H01R 4/64*** | (2006.01) |
| ***H01R 4/30*** | (2006.01) |
| ***H01R 13/422*** | (2006.01) |

(52) U.S. Cl.

CPC ..... *H01R 4/30* (2013.01); *H01R 4/64* (2013.01); *H01R 13/422* (2013.01)

(58) Field of Classification Search

CPC ... H01R 4/66; H02B 1/50; H02G 9/02; H02G 9/04

See application file for complete search history.

(56) References Cited

U.S. PATENT DOCUMENTS

| | | | | |
|---|---|---|---|---|
| 5,298,894 | A | 3/1994 | Cerny et al. | |
| 6,100,816 | A | 8/2000 | Moore | |
| 6,414,605 | B1 | 7/2002 | Walden et al. | |
| 7,462,061 | B2 * | 12/2008 | Balfour ..... | G02B 6/4439 439/409 |
| 7,603,020 | B1 | 10/2009 | Wakileh et al. | |

OTHER PUBLICATIONS

Seattle City Light, Standards for Electrical Service, 2018 Edition, pp. 63, 217, 225 (Year: 2018).*

* cited by examiner

*Primary Examiner* — Vanessa Girardi

(74) *Attorney, Agent, or Firm* — Peter J. Ims; Westman, Champlin & Koehler, P.A.

(57) ABSTRACT

An externally switchable lid for securing to a utility tracer wire access housing and for selectively conductively engaging and disengaging a buried ground rod in order to locate a utility line via the tracer wire. The lid has a first surface supporting a switch and a second surface supporting a first terminal for connecting a tracer wire directly to the lid and the first terminal having a first end of a switch jumper fixedly secured thereto and a second terminal for connecting a ground wire to the ground switch. A locking mechanism is provided for securing the lid to the access housing while the lid is accessible above-ground. The lid connects to the access housing which has a length of the tracer wire and the ground wire extending from connection with the lid and extending underground.

16 Claims, 5 Drawing Sheets

EXTERNAL SWITCH TO CONNECT OR DISCONNECT UNDERGROUND TRACER WIRE AND GROUND WIRE

CROSS-REFERENCE TO RELATED APPLICATIONS

The present application is based on and claims the benefit of U.S. Provisional Patent Application Ser. No. 62/782,210, filed on Sep. 7, 2018 and U.S. Provisional Patent Application Ser. No. 62/821,815, filed on Mar. 21, 2019, the contents of which are hereby incorporated in their entirety.

BACKGROUND

Detecting the precise location of underground utilities is critical in protecting valuable infrastructure assets and in saving lives. Utility locating systems utilize tracer wire buried alongside a utility line to detect the location of the underground utility lines. The tracer wire carries a signal that can be detected above ground with line locating equipment.

A low-voltage electric signal is applied to tracer wire by a utility locate transmitter. In order for the signal to be pulled along the tracer wire, the tracer wire must be properly grounded at all tracer wire dead ends and at other strategic points along the utility lines. Grounding of the tracer wire is generally done with a drive-in magnesium grounding rod with ground rod wire. The tracer wire and ground rod wire are terminated and connected at access points. Access points are stations that provide direct connection point for a utility locate transmitter to hook to tracer wire and a point to connect/disconnect the ground wire. A properly charged and grounded tracer wire system with protective access points are critical to locating from above ground and in protecting underground utilities from damage.

To locate underground tracer wire, it is important to be able to isolate different sections of the tracer wire system. To do that, you must be able to turn the grounds on and off. Turning the grounds on and off at different access points along the system will control flow of the electrical current and direct it to the target tracer wire. If the electrical current is not controlled in this manner, electricity will automatically flow to the strongest ground, which may draw the current away from the target line. Controlling the flow of electric current along tracer wire by controlling the grounds is critical in utility locating.

Typically, connecting and/or disconnecting the ground wire is done by unscrewing and removing the access point lid and manually connecting/disconnecting the ground wire from the terminal connection between the tracer wire and the ground wire. This manual disconnection and then reconnection is cumbersome and time consuming. Furthermore, dirt and debris can gather in the access point, and water can enter the access point depending on the weather at the moment of access, corroding the wires and requiring costly replacement or resulting in a failure to provide a signal for locating the corresponding utility.

SUMMARY

An aspect of the present disclosure relates to an externally switchable lid for switching a ground signal on and off. The lid allows for the external switching of the ground signal between and "on" and an "off" position without requiring removal of the lid. The lid comprises at least two terminals or more such as three, four, five or more terminals.

Another aspect of the present disclosure relates to an externally switchable lid for securing to a utility tracer wire access point. The lid has a top surface supporting a ground switch and direct connection point(s) for a transmitter, and a bottom surface supporting terminal connection points for tracer wire and ground wire. A jumper joins the tracer wire terminal(s) to the ground terminal(s). The tracer wire terminal(s) connects to the direct connection point on the top of the lid, and the ground wire terminal connects to the ground switch at the top of the lid. The lid attaches to a housing that extends underground such that the switch and direct connection point(s) is accessible from above ground and wherein the tracer wire and the ground wire extend through connections to the bottom surface of the lid and down through the housing and underground. The lid may further comprise a locking mechanism for securing the lid to the housing.

The ground switch engages and disengages connection to the jumper which engages or disengages the electrical connection between the ground wire and the tracer wire. The ground switch movable between two positions—a first position and a second position. In the first position, the ground terminal touches the jumper, and the connection between the tracer wire and the ground wire is engaged. In the second position, the ground terminal does not touch the jumper (space between), and the connection between the tracer wire and the ground wire is disengaged.

Another aspect of the present disclosure relates to a method of conductively engaging and disengaging a buried ground rod in order to locate a utility line using a buried tracer wire. The method includes providing a lid having a top surface supporting a ground switch and direct connection point(s) and a bottom surface supporting a ground terminal for connecting a ground wire secured to the ground rod to the ground switch and tracer wire terminal(s) for connecting tracer wire to the direct connection point on the top of the lid. The lid is secured to an access point, wherein the access point is at least partially buried underground and wherein the access point supports terminal ends of the ground wire and tracer wire therein for connection to the ground and tracer wire terminals on the bottom surface of the lid. The ground switch is a switch movable between a first position to effectuate movement of a conductive surface to conductively connect the ground rod with the tracer wire and a second position to conductively disengage the ground rod from the tracer wire from an above ground surface position. Locking the lid in connection with the access point may be done by rotating a bolt with a threaded end extending from the bottom surface of the lid into connection with a collar of the access point.

Locating the utility line can be done by detecting a signal from the tracer wire when the ground rod is conductively disengaged from the tracer wire at the access point at which the transmitter is connected. Moving the ground switch effectuates conductively engaging or disengaging a conductive surface of the ground terminal with a ground switch jumper fixedly secured to the tracer wire terminal such that the switch moves the conductive surface to conductively engage or disengage the ground rod.

Yet another aspect of the present disclosure relates to an externally switchable lid for securing to a utility tracer wire access point. The lid has a top surface supporting a ground switch and a direct connection point, and a bottom surface supporting a ground terminal for connecting a ground wire to a ground switch and tracer wire terminal(s) for connecting tracer wire to a direct connection point on the top of the lid. The tracer wire terminal(s) also has a first end of a ground switch jumper fixedly secured thereto. The lid also has a locking mechanism for securing the connection of the lid to an access housing. The access housing houses a length of the tracer wire and the ground wire extending from their respective connections with the bottom surface of the lid with both wires extending though the access housing to their respective underground positions.

The locking mechanism may be a pentagon head bolt with a threaded end extending from the bottom surface of the lid for connection with a collar of the access housing for securing the lid to the access housing.

The ground switch is movable to conductively engage or disengage a second opposing end of the ground switch jumper with a conductive surface of the ground terminal to conductively engage or disengage a ground rod.

The lid described herein may be comprised of high-strength, impact-resistant non conductive resin having electrically insulative characteristics.

Yet another aspect of the present disclosure relates to a method of making an externally switchable lid by injection molding a high-strength, impact-resistant electrical insulating resin to form a lid having a top surface and a bottom surface and electrically conductive terminals supported therein, wherein the terminals extend outwardly from a bottom surface of the lid. A top surface of the lid supports a switch operably connected to a terminal and a connection point operably connected to additional terminals. The method includes securing a conductive element to one terminal on the bottom surface of the lid wherein at least one of the two conductive terminals is movable via movement of the switch so as to provide selective conductive contact between the terminal to which the conductive terminal is not secured to.

A locking mechanism may also be provided in the injection molded lid, the locking mechanism extending from a top surface through the lid to the bottom surface.

DETAILED DESCRIPTION

Figure 1:
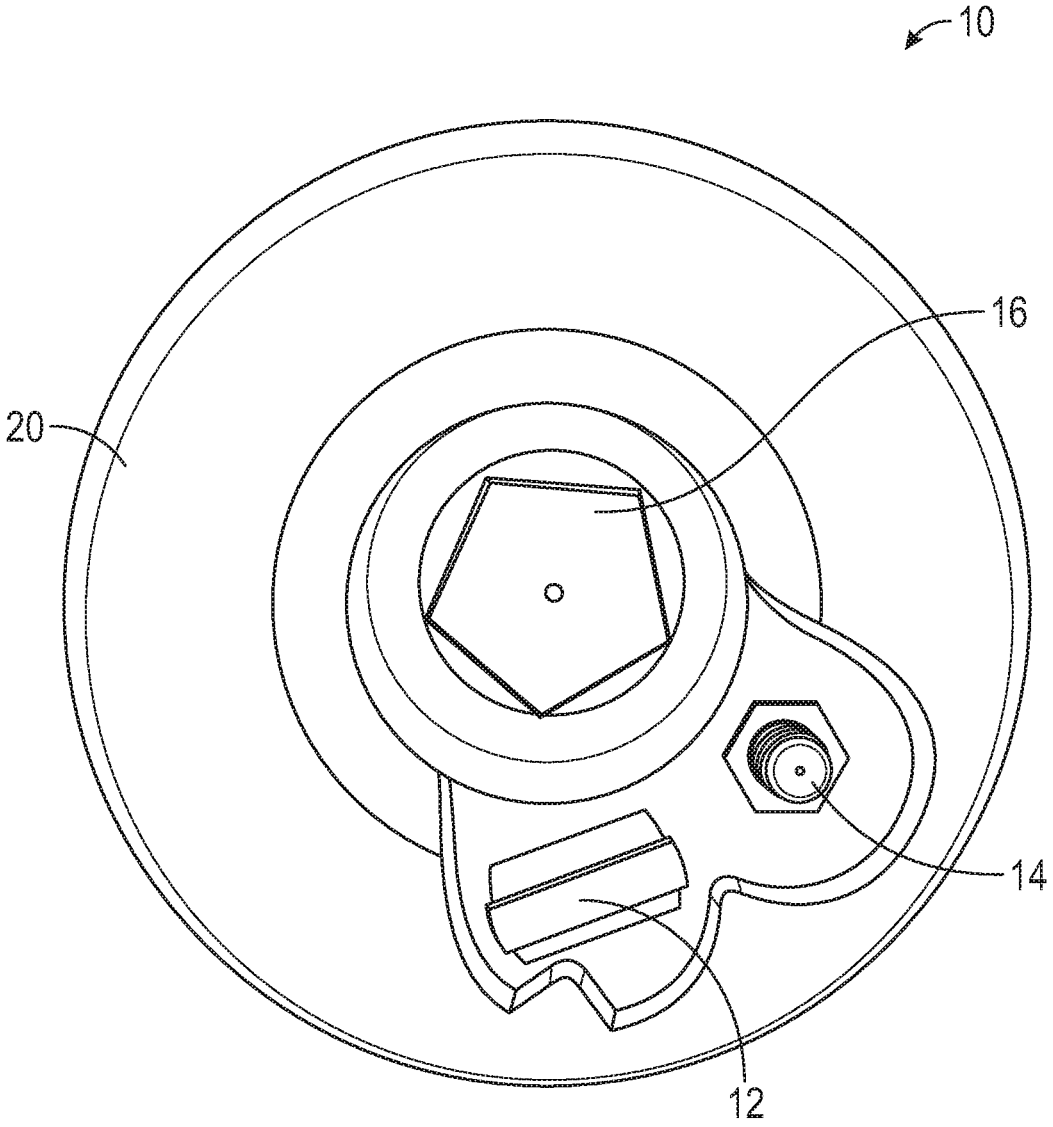
FIG. 1 is a top view of an externally switchable lid.

An externally switchable lid for switching a ground signal "on" and/or "off" is described herein. The lid is externally switchable in that the lid need not be removed from a housing to switch the ground signal on and/or off. The lid may include two terminals for connection to a ground and a tracer wire for example. Further, the lid described herein can include additional terminals such that the lid supports three, four, or more terminals up to twenty terminals or more. The externally switchable lid may be used in various applications including but not limited to cathodic protection, irrigation locating, pet fence locating, and utility locating. The embodiments described herein are directed to the externally switchable lid for use in locating a buried utility, however, the externally switchable lid can be utilized in any application wherein a ground signal is switched between on and off positions.

In one embodiment, a buried utility locating system comprises buried tracer or locator wire coextending along a length of buried utility cable or piping, for example. A second tracer or locator wire is then connected to a "ground" rod, also buried near terminal ends of the buried utility and at tracer wire access points along the length of the buried utility. The tracer or locator wire can be detected from above ground by detection of an electromagnetic field radiating from the tracer or locator wire, which is referred to as a "signal." Additionally, the locator system may include a tracer or locator wire that is a copper-clad steel tracer wire and a grounding rod at each access point conductively connected to the buried tracer wire along the utility line. Properly grounding the locator system tracer wire dead ends and at each access point along the utility line aids is crucial in pulling the signal along the tracer wire enabling location. For example, to detect the location of the utility line, a low voltage charge is applied on at a selected access point to a target line extending from that access point. Grounding the tracer wire at each access point will draw the locate signal down the line towards the adjacent access point(s), which is essential to locating. However, if the ground wire is not disconnected from the ground rod at the first access point, the first access point being where the low voltage is applied to the tracer wire, the voltage will travel down the ground wire at that first access point and will not travel along the tracer wire to the next access point. In other words the voltage will take the path of least resistance to the nearest ground rod, and the tracer wire will not be locatable. For the tracer wire to be locatable, the ground rod has to be conductively disconnected from the tracer wire at the first access point (where the low voltage is applied is the tracer wire). The low voltage will then travel to the next adjacent access point(s) where the tracer wire and the ground rod are conductively connected. This disclosure provides a solution for quickly and easily conductively disconnecting the tracer wire from the ground and then easily and quickly connecting the ground and the tracer wire.

In one embodiment, the externally switchable lid provides a user direct and quick access to an underground tracer or locator wire buried along with a utility cable or pipe and a corresponding underground ground rod at that access point. The terminals are supported by the lid and secured within a thickness of the lid. The tracer wire and grounding rod are buried underground with the installation of utility cables or pipes to allow the user to trace and determine the location of the cables or pipes at a later time. The externally switchable lid is positioned for access to a top surface of the lid at or above a ground surface. The externally switchable lid also allows the user to effectuate a switch above ground to conductively connect and disconnect the ground rod from the tracer wire system (e.g., turning the ground "on" and "off"), thus allowing a signal to travel along the tracer wire for location detection. The lid allows the user to conductively disconnect the ground wire via an above-ground accessible ground switch on the lid and apply low voltage to the tracer wire from above ground, for locating the wire along the utility line. This is done without removing the lid from the housing. That is, prior to voltage being applied to the tracer wire at an access point, the switch can be moved to effectuate the conductive disengagement of the ground wire at that access point only, allowing the voltage to travel down the tracer wire to the next access point. Further, the lid allows the conductive disengagement of the ground wire and application of the low voltage without removal of the lid or exposing the buried wire connections.

In the embodiment illustrated in FIGS. 1-4, an externally switchable lid 10 for accessing underground tracer wire 26 and a corresponding ground wire 24 is configured for secure connection to a base 11. The base 11 is a housing buried in the ground which the ground wire 24 and tracer wire 26 is fed through for utility locating. The lid 10 has a top surface 20 and a bottom surface 22. The top surface 20 of the lid 10 supports a ground switch 12 and a direct connection point 14 for the tracer wire 26. The top surface 20 also supports a locking mechanism 16 to ensure secure connection of the lid 10 to the base 11 to allow for a secure seal between the lid 10 and base 11. When installed on the base 11, the top surface 20 is accessible from above ground.

The locking mechanism 16 secures the lid 10 to the base 11 to prevent tampering. The locking mechanism 16 may be a notched bolt end to prevent loss of the locking mechanism 16. For example, the locking mechanism 16 secures the lid 10 to a collar of the base 11 in a closed position via a threaded length 17 extending from the bottom surface 22 of the lid 10. In the embodiment illustrated, the locking mechanism 16 comprises a pentagon head bolt 16. The locking mechanism may be an anodized aluminum bolt having about 0.830"-0.875" flat to vertex dimensions, which secures the lid 10 to a pre-existing base 11 as the locking mechanism 16 can only be removed with a proper pentagon wrench.

First terminal ends of the tracer wire 26 and ground wire 24 are connected to corresponding terminals on the bottom surface 22 of the lid 10. The ground switch 12 is connected to a ground switch terminal 12*c* which is used to physically connect the ground wire 24 to the lid and the ground switch 12 effectuated conductive engagement and disengagement of the terminal 12*c* and thus conductive engagement of the ground wire 24 with the direct connector 14 for the tracer wire 26. The ground switch 12 is configured to resist unintentional switching. A tool such as a standard or needle-nose plyers can be used for switching the ground switch 12. The tracer wire 26 is physically connected directly to the direct connector 14 as described in further detail below.

Figure 2A:
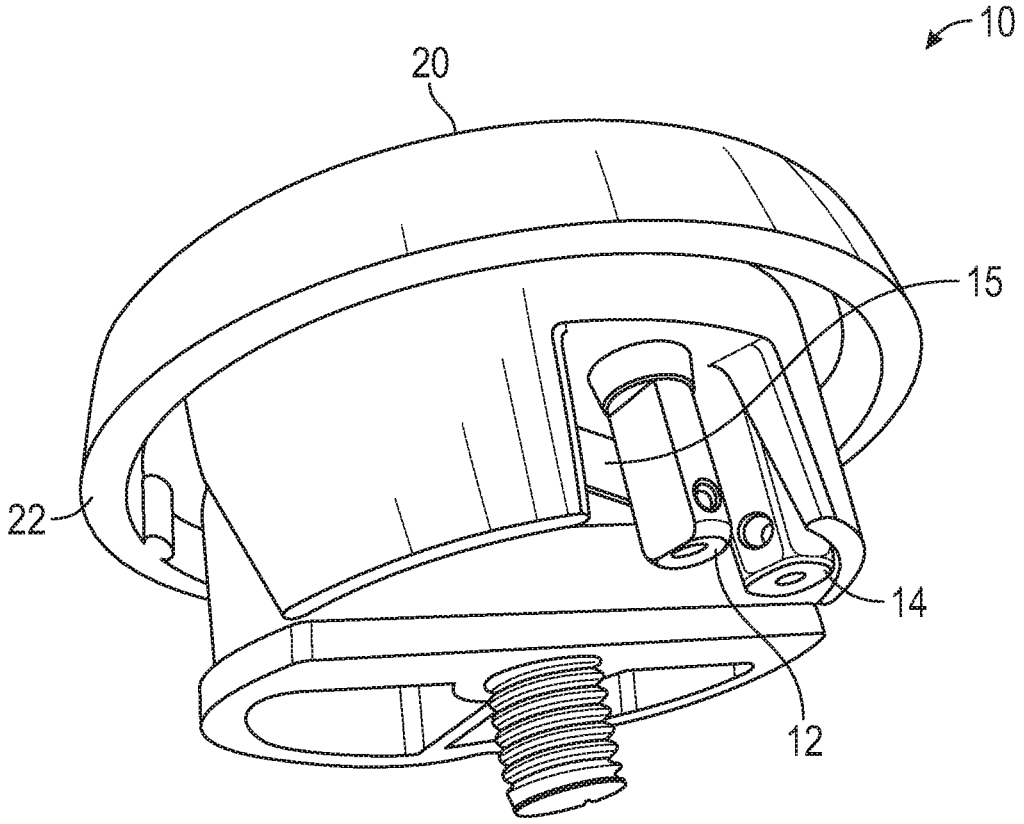
FIG. 2A is a side perspective view of the externally switchable lid.
Figure 2B:
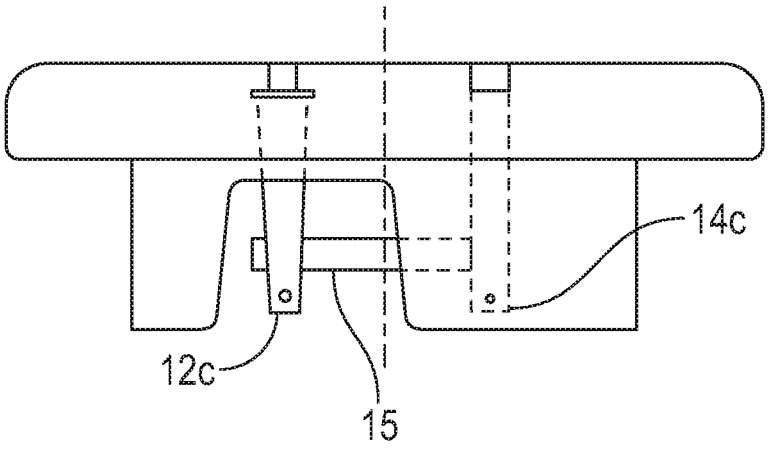
FIG. 2B is a side view of the externally switchable lid.
Figure 3:
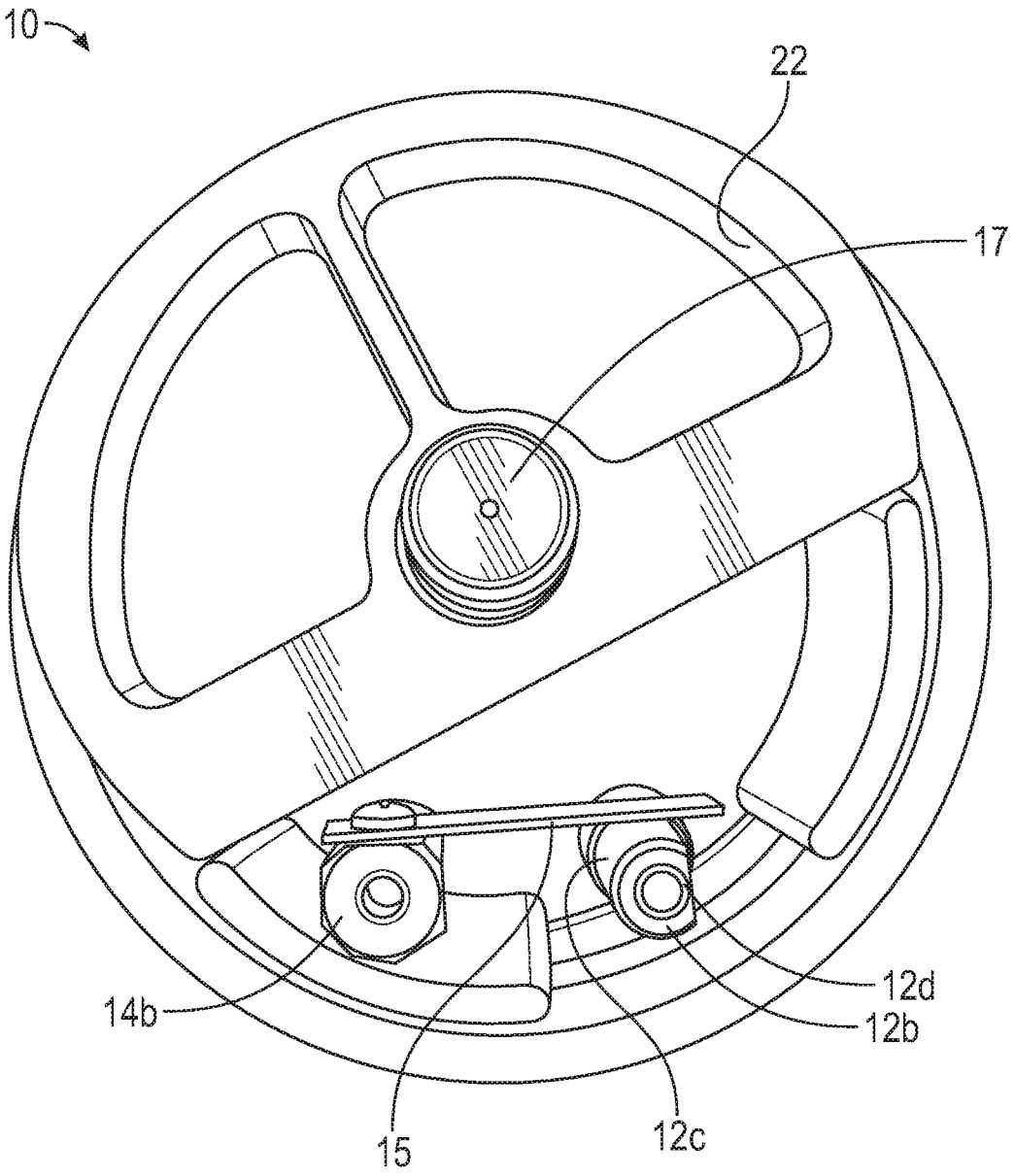
FIG. 3 is a bottom view of the externally switchable lid.
Figure 4:
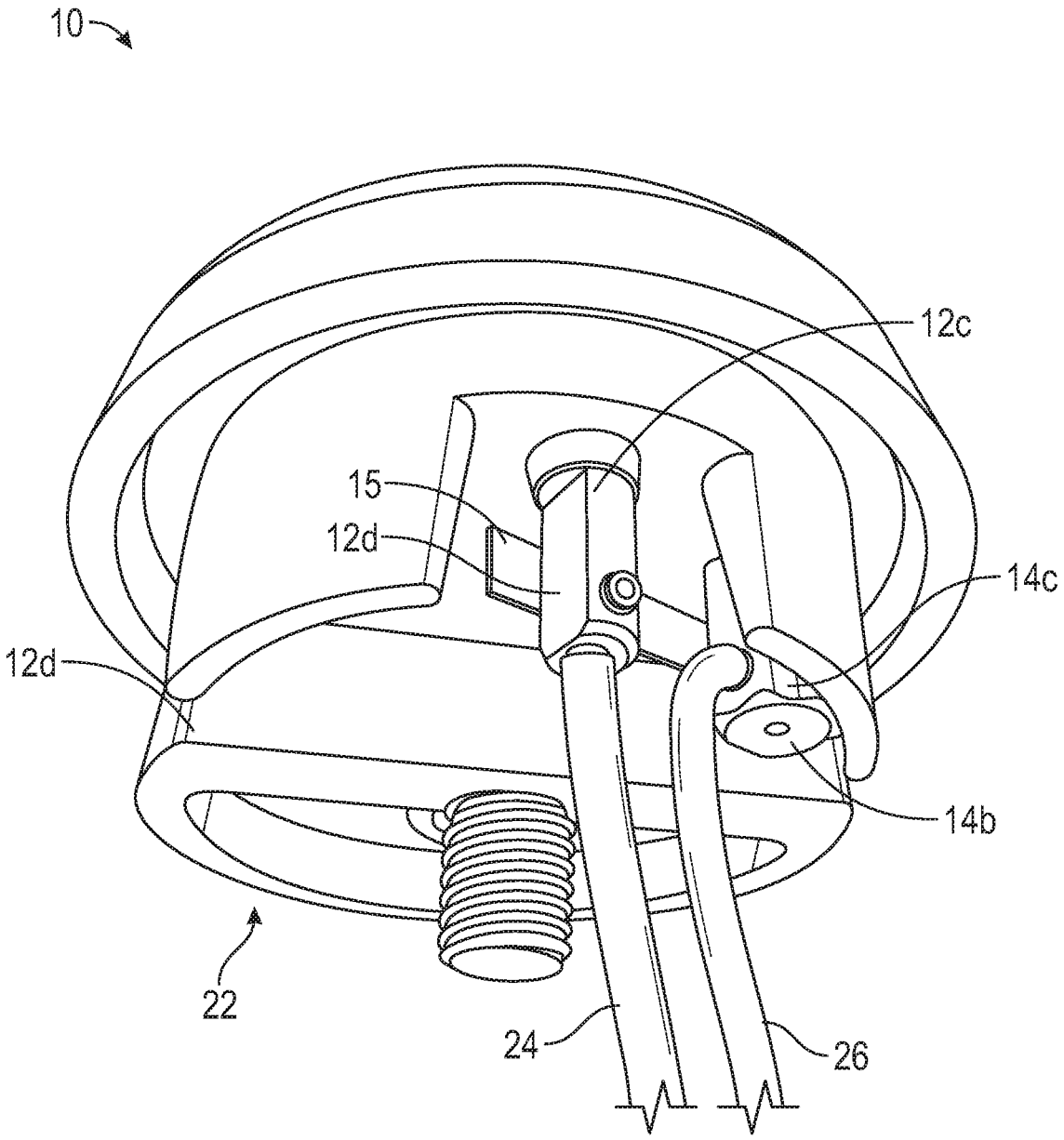
FIG. 4 is a bottom perspective view of the externally switchable lid.

Referring more specifically to FIGS. 2-4, the bottom surface 22 of the lid 10 supports a connection end 12*b* of a ground switch terminal 12*c* and also supports a connection end 14*b* of a direct connector terminal 14*c*. The ground switch 12 and the direct connector 14 for the tracer wire 26 extend from the top surface 20 of the lid 10 through apertures in a thickness of the lid 10 and are operably connected to the respective terminals 12*c* and 14*c*. Thus, a corresponding length, or terminal 12*c* and 14*c* of each of the ground switch 12 and the direct connection element 14 extends outwardly from the bottom surface 22 of the lid 10 to the top surface 20.

Thus, protruding from the bottom surface 22 of the lid 10 are the connection ends 12*b* and 14*b* which are configured for operable and physical connection or coupling with the first terminal ends of the ground wire 24 and tracer wire 26. For example, set screws are used to secure the tracer wire 26 and the ground wire 24 to the respective connection ends 12*b*, 14*b*.

The bottom surface 22 of the lid 10 also supports a ground switch jumper 15 which completes an electric circuit between the ground wire 24 and the direct connector terminal 14*c* by physical and conductive contact with the ground switch terminal 12*c* and concurrent conductive connection with the direct connector terminal 14*c*. The ground switch jumper 15 may be fixedly secured to the direct connector terminal 14*c*. The ground switch terminal 12*c* then has a disconnection mechanism 12*d*, which may be a generally flat surface 12*d* on one side of the terminal 12*c* and extending along a length of the terminal 12*c* from the bottom surface 22 of the lid 10 to the connection end 12*b*. This flat surface 12*d* provides a physical space between the ground switch terminal 12*c* and the ground switch jumper 15, this physical space breaking the conductive connection and effectively disengaging the ground wire 24 from conductive connection with the direct connector terminal 14*c*. When the ground switch 12 is "switched" to an "on" or conductive position, the terminal 12*c* is moved into physical and conductive connection with the ground switch jumper 15. When the ground switch 12 is switched to an "off" or non-conductive position, the terminal 12*c* is moved away from the jumper 15 and the disconnection mechanism 12*d* is moved toward a face of the ground switch jumper 15, thus providing the space between the terminal 12*c* and the jumper 15. The disconnection mechanism 12*d* does not physically contact the jumper 15 in the disengaged or "off" position. Examples of the ground switch 12 include but are not limited to a toggle switch or a rotatable switch which effects rotation or other movement of the terminal 12*c* between a first "on" or conductive position and a second "off" or nonconductive position where the disconnection mechanism 12*d* is moved or rotated toward the jumper 15. It is also contemplated that a ground switch arrangement configured to effectuate movement of the ground switch jumper away from conductive contact with the ground wire or ground wire terminal can be incorporated.

The lid 10 may be comprised of a high-strength, impact-resistant nonconductive resin such that the lid 10 resists chipping and oxidization. The nonconductive characteristic of the lid provides electrical insulation between the terminals 12 and 14. For example, the lid 10 may be formed by injection molding a non-corrosive resin. The lid 10 illustrated in the figures has a flexural strength of about 28,300 psi, and is conditioned per standard ISO 178. The lid 10 has an impact rating of 43 (−22° F.)/44 (73° F.) ft lb/in2 per an unnotched Charpy impact properties determination according to ISO standard 179/1 eU. The lid 10 also has a melting temperature of about 451° F., determined per ISO 11357-3.

The ground switch 12, its connector end 12*b* and terminal 12*c* as well as the direct connector 14, connection end 14*b* and connection terminal 14*c* are comprised of a conductive metal such as brass. The ground switch jumper 15 is also comprised of a conductive metal such as brass. The locking mechanism 16 is an anodized aluminum pentagon head bolt.

Second terminal ends of the ground wire 24 and the tracer wire 26 extend from operable connection with the respective ground switch connection end 12*b* and direct connect mechanism end 14*b*, and through the base 11. The base 11 may be an underground buried housing. The second terminal end of ground wire 24 is then operably connected to a ground rod 28, also buried underground. The tracer wire 26 is directly connected to the direct connect mechanism 14 on the lid 10 and the length of the tracer wire 26 then extends through the housing 11 and continuously or substantially continuously (e.g., additional lengths of wire may be obtained via splicing wires) along the length of a buried utility line 36. The buried utility line 36 may comprise piping or cables for delivery of the utility. The utility line may be electric, gas, communication, potable water, sanitary sewer, storm sewer, or reclaimed water, for example.

Figure 5B:
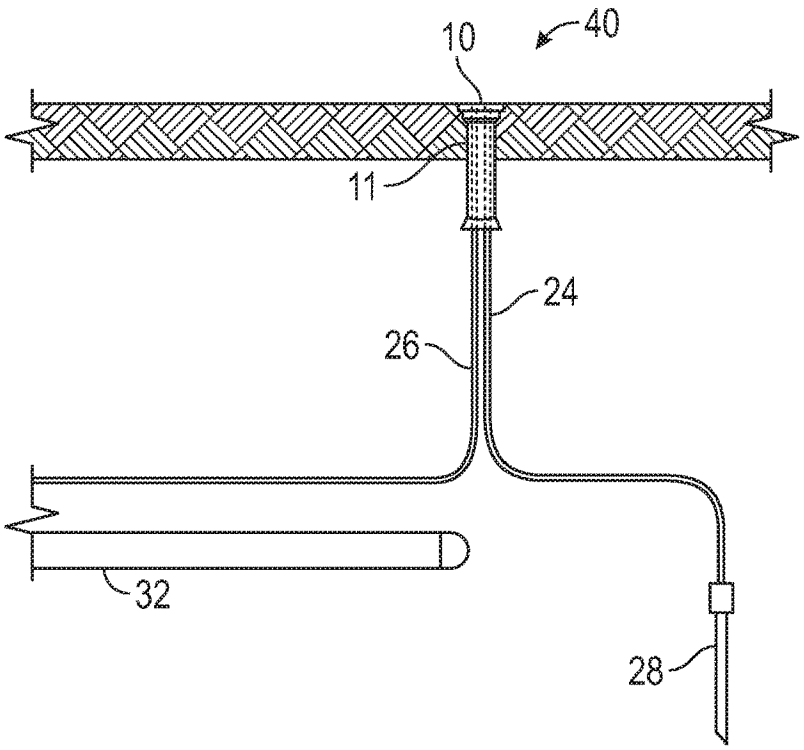
FIG. 5B illustrates an end or stub installation using the externally switchable lid.
Figure 5A:
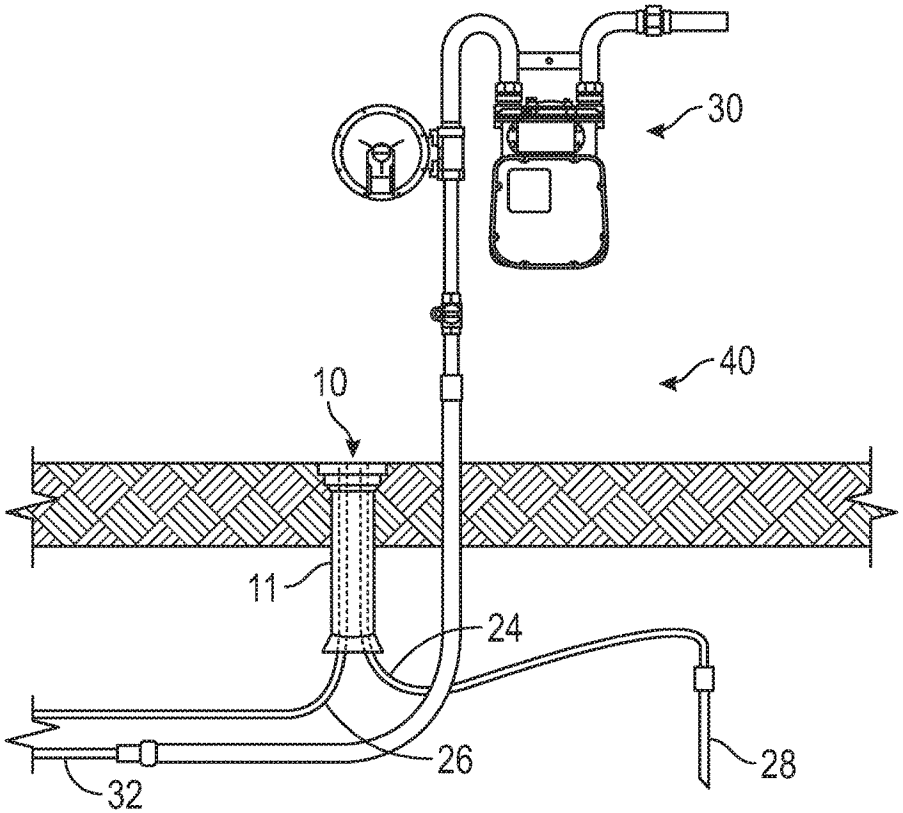
FIG. 5A illustrates a utility meter set installation using the externally switchable lid.

As illustrated in FIGS. 5A and 5B, the lid 10 is secured to the base 11 at one or more access points 40. The access points 40 may be at or near a utility meter as illustrated in FIG. 5A, or at a terminal end of the utility line as illustrated in FIG. 5B. Additional access points 40 may be provided a various selected points along a length of the utility line 36 or as otherwise required by the utility installation. On the utility line 36 there are generally a plurality of access points 40 along the line 36 which are used for utility line location finding. The lid 10 described herein can be used at each access point 40 to disengage a conductive connection between the ground wire 24 and the direct connector terminal 14*c*, without removal of the lid 10. The ground wire 24 is disengaged from the electrical connection with the direct connector terminal 14*c* when a low voltage is applied to the tracer wire 26 via the direct connector 14 to allow for detecting the signal from the tracer wire 26 along a length of the buried tracer wire 26 between at least two access points 40. This allows the low voltage current applied to the tracer wire 26 to flow down the tracer wire 26 to the next adjacent access point 40. Thus user can then locate the tracer wire 26 along the utility line 36 for marking the utility line location. The ground wire 24 must be disengaged from the conductive connection at a first access point 40 when voltage is applied to the tracer wire 26 at that first access point 40, otherwise the current would terminate at the ground rod 28 at the first access point 40, preventing location of the tracer wire 26 and utility line 36. Thus, moving the ground switch 12 from a first position to a second position effectuates movement of the ground switch terminal 12*c* to either conductively engage the ground switch terminal 12*c* with the ground switch jumper 15 in a first position, or to conductive disengage the ground switch terminal 12*c* with the ground switch jumper 15 in a second position by moving the disengagement mechanism 12*d* towards a face of the ground switch jumper 15, the spacing the terminal 12*c* away from the jumper 15.

The illustrated embodiment includes two terminals for purposes of illustration of the externally switchable lid, however the lid can be configured for and having dimensions to support additional terminals. For example, the externally switchable lid may have any number of terminals, including two, three, four or more and up to twenty or more terminals.

The lid 10 thus remains secured to the base 11 when a user connects or disconnects the locating system from the grounding 28. The lid 10 also remains secured to the base 11 when applying the low voltage to the tracer wire 24.

When installing the lid 10, the tracer wire 26 is connected with a set screw to the direct connector 14 and terminal 14*c* via connection end 14*b*. The ground wire 24 is connected with a set screw to the connection end 12*b* of terminal 12*b* of the ground switch 12. Further, an anti-corrosion gel may also provided with the lid 10 and applied to the wire connections and a ground switch jumper 15 connection point with the direct connector 14 terminal 14*c* to prevent oxidation of the metal components.

The lid 10 can be provided in various colors, such that the lid 10 is color-coded to meet American Public Works (APWA) standards to provide instant identification of the traced utility. For example, the lid can be provided in the appropriate color red to identify electric utilities, yellow for gas, orange for communication, blue for potable water, green for sewer and purple for reclaimed water.

Although the present disclosure has been described with reference to preferred embodiments, workers skilled in the art will recognize that changes may be made in form and detail without departing from the spirit and scope of the disclosure.

The invention claimed is:

1. An externally switchable lid for securing to a utility tracer wire access point, the lid comprising:

a top surface supporting a switch and a connector;

a bottom surface supporting a first terminal configured to connect to a ground wire to the switch and supporting a second terminal conductively connected to the connector and the second terminal configured to connect to a tracer wire such that the connector is in conductive communication with the tracer wire, where the second terminal has a first end of a switch jumper fixedly secured thereto; and a locking mechanism, wherein the lid is configured to be secured to a housing with the locking mechanism, and wherein the ground switch is movable to conductively engage or disengage the first terminal with the switch jumper to conductive connect the first and second terminals or conductively disconnect the first and second terminals.

2. The lid of claim 1 wherein the locking mechanism comprises a pentagon head bolt with a threaded end extending from the bottom surface of the lid, the bolt configured to threadably engage a collar of the housing, such that the lid is secured to the housing.

3. The lid of claim 1 wherein the lid is formed by injection molding a high-strength, impact-resistant electrical insulating resin.

4. The lid of claim 3, wherein the locking mechanism is secured through the injection molded lid so that the locking mechanism extends from above a top surface through a thickness of the lid to below the bottom surface.

5. An externally switchable lid, the lid comprising:

a main body having a top surface and a bottom surface and a thickness therebetween, wherein the main body supports a ground switch located above the top surface; and the bottom surface having a plurality of terminal connection positions extending therefrom, wherein the plurality of terminal connection portion comprises a first terminal for connecting to a ground wire and a second terminal for connecting to a tracer wire wherein a portion of the second terminal extends above the top surface of the main body, wherein the lid configured to be connected to a housing such that the ground switch is accessible without removing the lid from the housing, the ground switch configured to move between a first position wherein the first terminal and the second terminal are conductively connected and a second position wherein the first terminal and the second terminal are conductively disconnected such that a device can be conductively connected to the portion of the second terminal and send a signal through the portion of the second terminal and along the tracer wire.

6. The lid of claim 5 wherein the housing is positioned underground, such that the ground switch is accessible from above a ground surface.

7. The lid of claim 5 wherein the lid is comprised of high-strength, impact-resistant electrical insulating resin.

8. The lid of claim 5 and further comprising a locking mechanism for securing the lid to the housing.

9. The lid of claim 8 wherein the grounding switch is operably connected either the first or the second terminal connecting points.

10. The lid of claim 5 wherein the ground switch is rotated between the first position and the second position.

11. The lid of claim 10 wherein the ground switch is operably connected to the first terminal.

12. The lid of claim 10 and further comprising a ground switch jumper fixedly secured to the second terminal, wherein the ground switch jumper is configured to complete the conductive connection with the first terminal when the ground switch is in the first position.

13. The lid of claim 12 wherein the first terminal comprises an accurate portion and a substantially flat portion, wherein when the ground switch is in the first position, the arcuate portion conductively contacts the ground switch jumper and when the ground switch is in the second position, the flat portion faces and is spaced from the ground switch jumper to conductively disconnect the first and second terminals.

14. A method of tracing a buried utility line, the method comprising:

moving a switch extending from a lid of an access housing, wherein a ground wire is coupled to a first terminal extending into the access housing from the lid and coupled to a ground rod, and wherein a tracer wire is coupled to a second terminal extending into the access housing and having a coupling extending from the lid, wherein the access wire extends along a buried utility line, from a first position for effectuating conductive engagement of the first and second terminals to a second position for effectuating conductive disengagement of the first and second terminals; and applying a low voltage signal to the coupling for direct access to the second terminal and thus applying voltage only to the tracer wire.

15. The method of claim 14 wherein the access housing is at least partially buried unground.

16. The method of claim 14 and further comprising moving the switch back to the first position after stopping the application of the low voltage signal to the tracer wire.

* * * * *